US005274891A

United States Patent [19]

Biancalani

[11] Patent Number: 5,274,891

[45] Date of Patent: Jan. 4, 1994

[54] FULLING MACHINE WITH CYLINDER WITH INTERNAL MOTOR DRIVE

[75] Inventor: Fiorenzo Biancalani, Prato, Italy

[73] Assignee: Officina Meccanica Biancalani & C. Di Biancalant Fiorenzo & S.C.n.c., Florence, Italy

[21] Appl. No.: 898,303

[22] Filed: Jun. 15, 1992

[30] Foreign Application Priority Data

Jun. 17, 1991 [IT] Italy ..... FI91 A 000141

[51] Int. Cl.[5] ..... D06C 17/02

[52] U.S. Cl. ..... 26/20; 26/19; 492/15

[58] Field of Search ..... 26/19, 20, 87, 51, 71, 26/21, 22, 24, 99; 29/115, 116.1; 492/15

[56] References Cited

U.S. PATENT DOCUMENTS

| | | | |
|---|---|---|---|
| 854,030 | 5/1907 | Dowd | 26/20 |
| 897,152 | 8/1908 | Rockstroh | 492/15 |
| 2,095,216 | 10/1937 | Hunter et al. | 26/20 |
| 2,950,507 | 8/1960 | Keyser | 492/15 |
| 4,070,738 | 1/1978 | Göbel | 26/19 |
| 4,928,505 | 5/1990 | Parks et al. | 29/115 |
| 4,930,415 | 6/1990 | Hara et al. | 29/115 |

FOREIGN PATENT DOCUMENTS

| | | | |
|---|---|---|---|
| 0419825A1 | 8/1990 | European Pat. Off. | D06B 3/16 |
| 0414650A1 | 2/1991 | European Pat. Off. | D06C 17/00 |
| 0519884A1 | 12/1992 | European Pat. Off. | D06C 17/04 |
| 862294 | 7/1949 | Fed. Rep. of Germany . | |
| 1216234 | 5/1966 | Fed. Rep. of Germany . | |
| 1221604 | 7/1966 | Fed. Rep. of Germany . | |
| 2202290 | 5/1974 | France | 492/15 |
| 6034891 | 10/1971 | Japan | 492/15 |
| 857000 | 12/1960 | United Kingdom . | |
| 2032703 | 5/1980 | United Kingdom | H02K 7/10 |

*Primary Examiner*—Clifford D. Crowder
*Assistant Examiner*—Amy B. Vanatta
*Attorney, Agent, or Firm*—McGlew and Tuttle

[57] ABSTRACT

In a fulling machine for textiles and the like, comprising a pair of drawing cylinders (3, 4) between which the textile (T) is made to pass and means of driving said cylinders, said driving means comprise, for each cylinder (3, 4), a motor (13) disposed inside the cylinder itself with the motor drive shaft extending in a direction perpendicular to the cylinder axis of rotation. In this way a substantial reduction in the transverse dimension is obtained.

15 Claims, 3 Drawing Sheets

FULLING MACHINE WITH CYLINDER WITH INTERNAL MOTOR DRIVE

FIELD OF THE INVENTION

The invention relates to a fulling machine for textiles or similar, comprising a pair of cylinders for drawing the textile and means of driving said cylinders in rotation.

BACKGROUND OF THE INVENTION

Fulling machines are machines used for the treatment of cord textiles, in which the textile is made to circulate within a vessel on whose bottom a treatment liquid is present. The textile is removed from the bath by means of a pair of cylinders with parallel axes rotating in opposite directions, and is impelled by these cylinders into a fulling box where the textile is compressed to cause it to shrink.

At present these machines are driven by means of electric or hydraulic motors and with a belt transmission which transmits the motion to the two cylinders of each fulling machine or mechanism. This is also true of multiple fulling machines constructed with dependent or independent fulling mechanisms, as for example in the machine described in Italian utility model application no. 11677 B/89 in the name of the present applicant.

These systems of driving the cylinders are particularly cumbersome, especially in the case of multiple fulling machines with an independent drive for each fulling mechanism, since the belts and the associated pulleys for the transmission of the motion from the motor to the two cylinders of each pair have a considerable transverse extension.

SUMMARY AND OBJECTS OF THE INVENTION

The subject of the invention is a machine which has a new type of cylinder drive which enables the transverse dimensions of the machine to be substantially reduced.

The machine according to the invention is substantially a machine wherein the cylinder drive means comprise, for each cylinder, a motor disposed inside the cylinder itself.

Further advantageous embodiments of the invention are mentioned in the attached claims.

In particular, since the cylinders of the fulling machine have a rather large diameter with respect to their axial extension, the motor is housed inside the cylinder with its axis substantially perpendicular to the axis of said cylinder. The motor is advantageously housed inside a box which may be sealed in order to protect the motor, especially when an electrical motor is used; this box may advantageously be supported by a shaft which projects from the ends of the corresponding cylinder and is supported in a fixed way on the sides of the machine. The supports of the corresponding cylinder may be disposed on this shaft.

A reduction unit may advantageously be disposed between the motor and the cylinder; the motion from the motor may advantageously be transmitted to the corresponding cylinder through a pinion which engages with a ring gear integral with one of the closure disks or with one of the two ends of the corresponding cylinder.

In a particularly advantageous embodiment, the two cylinders of the fulling mechanism are driven by electric motors which are both controlled preferably by a single inverter. The use of electric motors makes it possible considerably to simplify their power supply, and the use of a single inverter for each pair of cylinders substantially reduces the cost of the equipment.

As mentioned above, the use of the type of drive according to the invention is particularly advantageous in the case of multiple independent fulling machines, in which each fulling mechanism is provided with cylinder drive means independent of the adjacent mechanisms. In this case the reduction in transverse dimensions is substantial.

BRIEF DESCRIPTION OF THE DRAWINGS

The drawing schematically illustrates a non-restrictive example of the invention.

DETAILED DESCRIPTION OF THE PREFERRED EMBODIMENT

Figure 1:
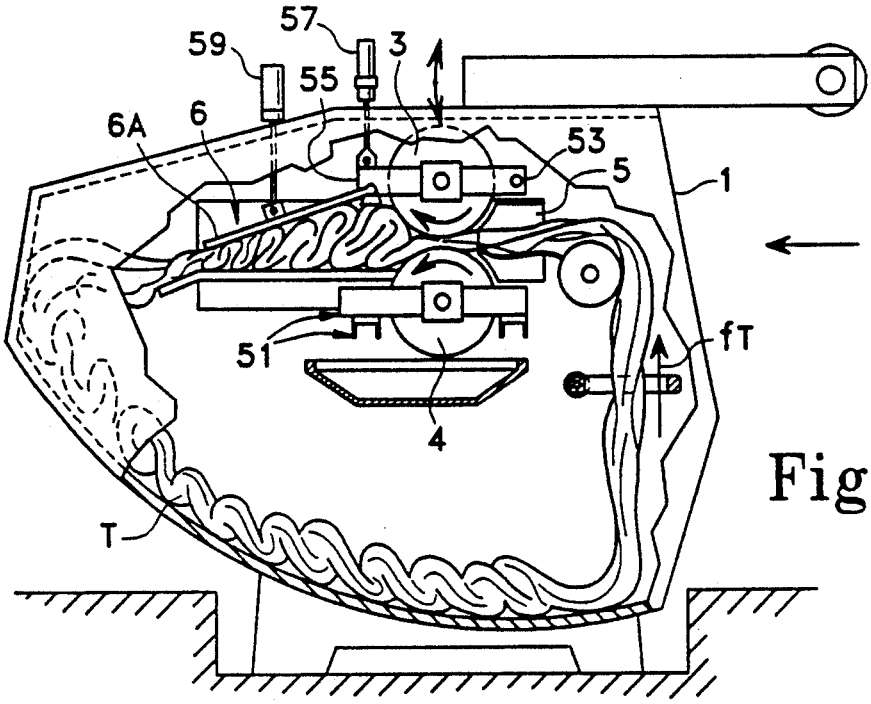
FIGS. 1 and 2 show in a highly schematic way a fulling machine in longitudinal section and in transverse section respectively.
Figure 2:
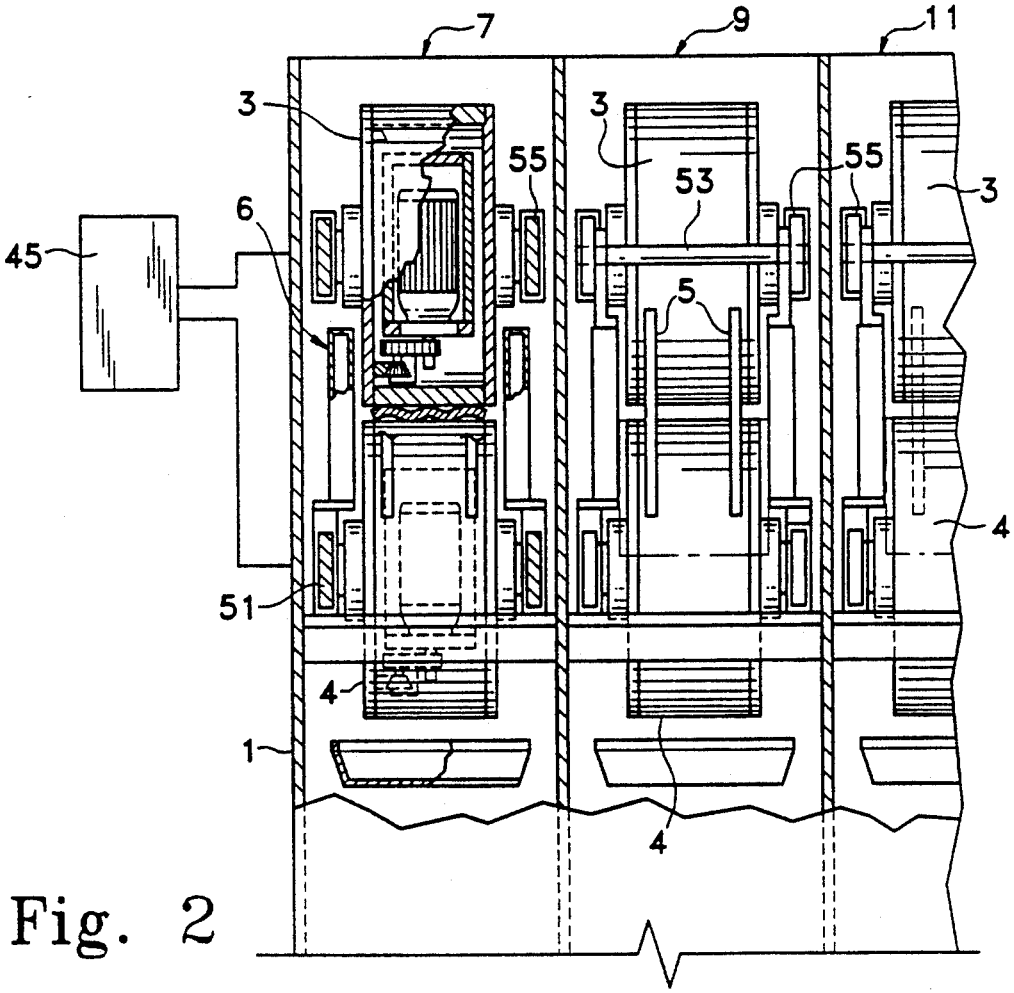

According to the illustration in the attached drawing, and with reference to FIGS. 1 and 2 initially, 1 indicates a vessel for the treatment of a cord textile, indicated in a general way by T. The textile is made to circulate inside the machine in the direction of the arrow fT shown in FIG. 1. The movement of the textile is obtained by means of a pair of cylinders 3 and 4 with parallel and contra-rotating axes, between which the textile is made to pass. Cushions or jaws 5 are disposed upstream of the cylinders 3 and 4 to compact the textile T transversely as it enters the two drawing cylinders 3 and 4. A box 6 which has the function of compacting the textile leaving the cylinders 3 and 4 is located downstream of the cylinders 3 and 4 (with respect to the direction of advance of the textile). The textile is made to circulate repeatedly between the various components of the machine to achieve the desired treatment, as is known to experts in the field.

FIG. 2 shows the same elements as FIG. 1, in a front view. In this figure a number of fulling mechanisms 7, 9, and 11 are represented; each of these has pairs of cylinders 3 and 4 which are independent of each other. Characteristically, according to the invention, the movement of each of the cylinders 3 and 4 is obtained by means of a corresponding motor indicated by 13 in FIG. 2, housed inside each cylinder 3 and 4.

Figure 3:
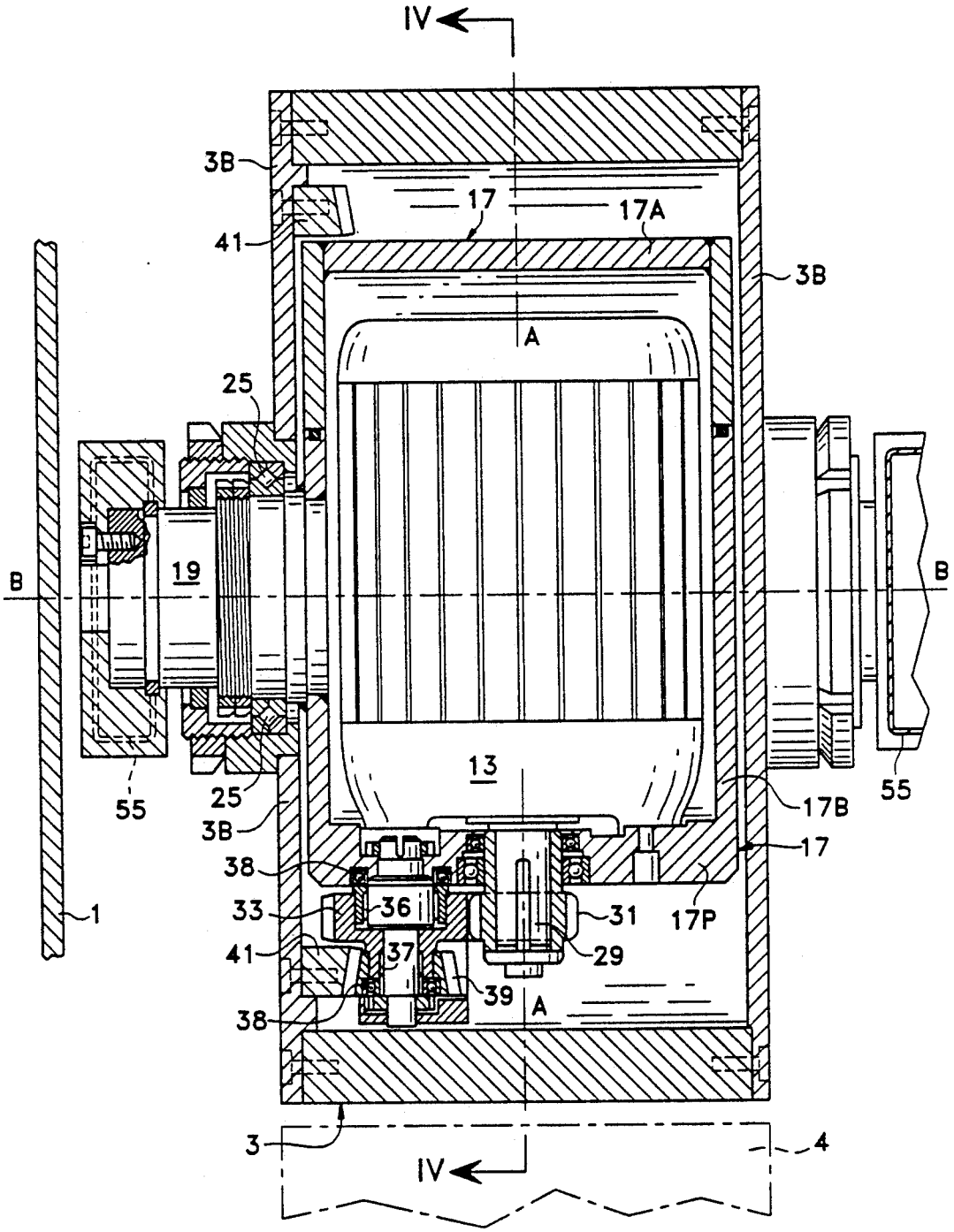
FIG. 3 shows a longitudinal section of a cylinder with an internal motor.
Figure 4:
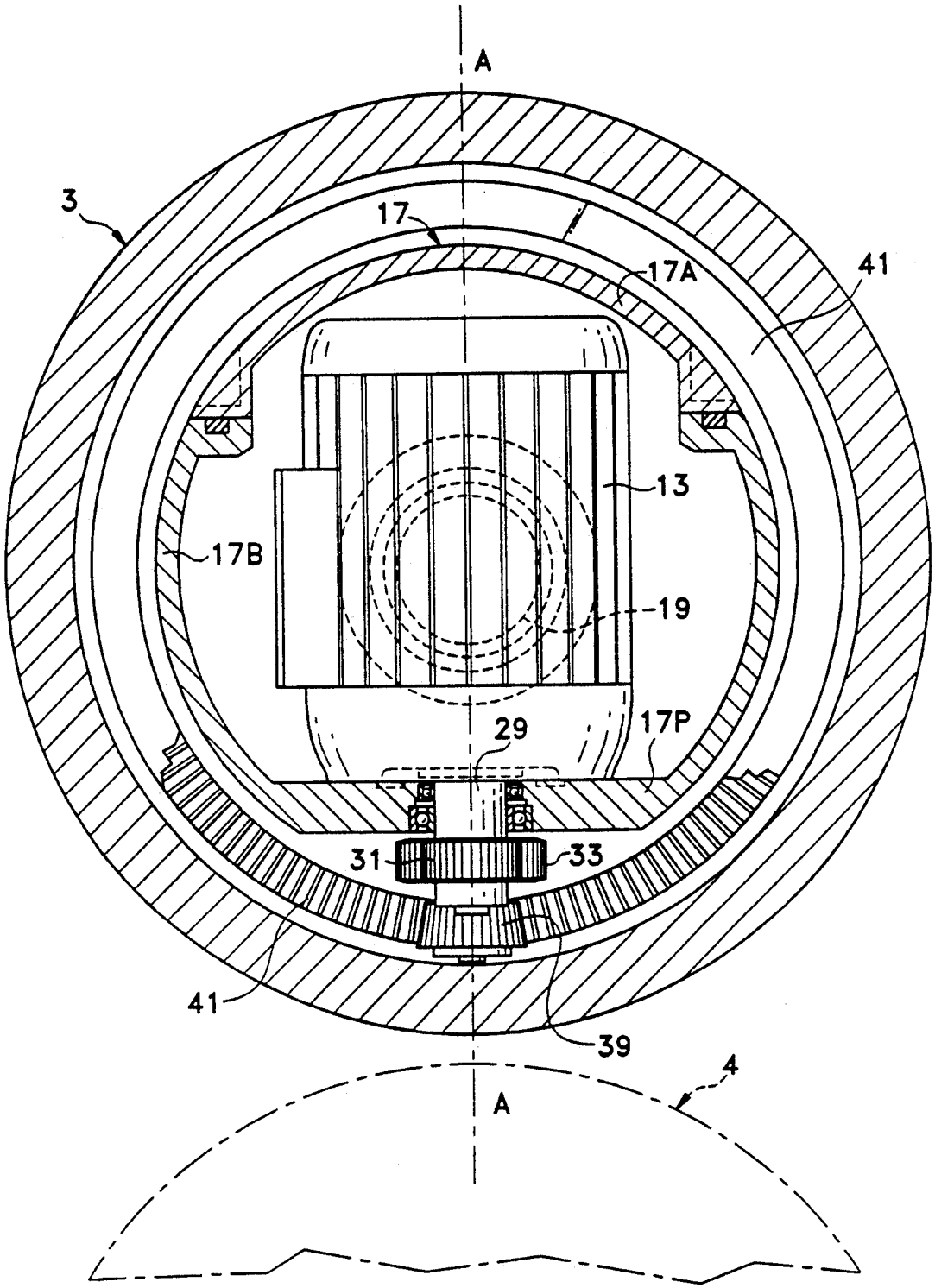
FIG. 4 shows a section along IV—IV in FIG. 3.

The disposition of the motor inside the corresponding cylinder is indicated for a single cylinder in FIGS. 3 and 4, the disposition of the other cylinder of each pair being symmetrical or identical.

In FIGS. 3 and 4 the cylinder is indicated by 3, and the motor by 13. The motor 13 has an axis A—A substantially perpendicular to the axis B—B of the cylinder 3.

The motor 13 is supported inside a box 17 consisting of two portions 17A and 17B coupled together in a sealed way. The box 17 is supported by two shafts 19 and 21 which project from the closure disks 3B of the cylinder 3 and are firmly attached to the structure 23 of the machine. In this way the box 17 is fixed with respect to the casing of the machine, while the cylinder 3 is free to rotate. For this purpose, the cylinder 3 support bearings are mounted on the shafts 19 and 21. The bearings 25 mounted on the shaft 19 may be seen in FIG. 3, the bearings on shaft 21 being disposed in a substantially symmetrical way. The two shafts 19, 21 are hollow to permit the passage of the motor supply line, and, if necessary, the cooling air. Suction means which keep the interior of the box slightly depressurized may advantageously be used for cooling.

The motor 13 is attached by a flange to a flat portion 17P of the box 17, from which the shaft 29 of the motor 13 projects. A first pinion 31 is keyed to the shaft 29 and engages with a gear wheel 33 supported by an auxiliary shaft 35 firmly attached to the box 17. The gear wheel 33 is supported by means of rollers 36 and 37 by means of thrust bearings 38. A bevel pinion 39 is integral with the gear wheel 33 and in turn engages with a ring bevel gear 41 integral with one of the two sides or ends 3B of the cylinder 3. The set of gears 31, 33, 39, and 41 form a reduction mechanism for the motion from the motor 13 to the cylinder 3, which must rotate at a relatively low speed for the purposes associated with the processing cycle to which the textile T is subjected.

The two motors 13 associated with the two cylinders of each pair are advantageously controlled by a single inverter schematically indicated by 45 in FIG. 2, in order to obtain, at low cost, control of the speed of rotation of the cylinders, in such a way that there is no difference in peripheral speed, which might damage the textile being treated, between them. To permit control of the speed of rotation of the two cylinders, encoders associated with the corresponding motors may be used.

FIGS. 1 and 2 further show a fixed frame 51 which supports the bearings of the lower cylinder 4. Reference number 53 denotes the pivots of arms 55 on which bearings of upper cylinder 3 are supported. Upper cylinder 3 is stressed toward cylinder 4 by a pneumatic spring 57. A further pneumatic spring acts onto a mobile wall 6A of box 6. This arrangement is known in the art.

I claim:

1. A fulling machine, comprising:

a fulling machine support including a fulling machine vessel;

a pair of drawing cylinder positioned within said vessel, each of said cylinders having a circumferential surface of a given width, said cylinders being mounted for rotation about an axis of rotation to define a gap between a circumferential surface of one of said cylinders and a circumferential surface of another of said cylinders, each of said cylinders including:

a motor positioned within said cylinder, said motor having a connected drive shaft, said motor being positioned within said cylinder with said drive shaft extending in a direction perpendicular to said cylinder axis of rotation;

mounting means connected to said support for supporting said motor in a fixed position within said cylinder; and transmission means for driving said cylinder in rotation via said motor drive shaft, said transmission means including a conical bevel gear positioned within said cylinder coaxial with said cylinder and a conical bevel pinion connected to said drive shaft and meshing with said conical bevel gear.

2. A fulling machine according to claim 1, wherein:

said mounting means includes a motor housing positioned within said cylinder, said motor being positioned in said motor housing, a fixed shaft extending through said cylinder from both sides of said cylinder, said fixed shaft being fixed to said motor housing and being fixed to said support at each side of said cylinder.

3. A fulling machine according to claim 2, wherein:

said cylinder is supported on said fixed shaft via bearings for rotation of said cylinder relative to said fixed shaft.

4. A fulling machine according to claim 1, wherein:

said motor and motor shaft have an axial dimension which is greater than said width of said cylinder.

5. A fulling machine according to claim 2, wherein:

said transmission means further comprises a reduction gear set including a pinion keyed to said motor shaft and a gear wheel supported by an auxiliary shaft fixably attached to said motor housing, said gear wheel being connected to said bevel pinion.

6. A fulling machine according to claim 1, wherein:

said motors are connected to a single inverter.

7. A fulling machine according to claim 4, wherein:

said fixed shaft is hollow, a power supply connecting said motor to a power source through said hollow fixed shaft.

8. A fulling machine according to claim 1, further comprising:

a plurality of fulling machines each having said pair of cylinders and said motors, said fulling machines being positioned adjacent to each other and being independently operated.

9. A fulling machine, comprising:

a fulling machine support including a fulling machine vessel;

a pair of drawing cylinders positioned within said vessel, each of said cylinders having a circumferential surface of a given width, said cylinders being mounted for rotation about an axis of rotation to define a gap between a circumferential surface of one of said cylinders and a circumferential surface of another of said cylinders, each of said cylinders including:

a motor positioned within said circumferential surface of said each of said cylinders, said motor having a connected drive shaft, said motor being positioned within said cylinder with said drive shaft extending in a direction perpendicular to said cylinder axis of rotation, said motor and drive shaft having an overall axial dimension greater than said width;

mounting means connected to said support for supporting said motor in a fixed position within said cylinder; and transmission means for driving said cylinder in rotation via said motor drive shaft, said transmission means including a conical bevel gear positioned within said cylinder coaxial with said cylinder and a conical bevel pinion connected to said drive shaft and meshing with said conical bevel gear.

10. A fulling machine, comprising:

a fulling machine support including a fulling machine vessel;

a pair of drawing cylinders, including a first cylinder and a second cylinder positioned within said vessel, each of said cylinders having a circumferential surface of a given width, said cylinders being mounted by cylinder bearing means for rotation about an axis of rotation to define a gap between a circumferential surface of one of said cylinders and a circumferential surface of another of said cylinders;

a first motor positioned within said first cylinder, said first motor having a connected first drive shaft, said first motor being positioned within said first cylinder with said first drive shaft extending in a direction perpendicular to said first cylinder axis of rotation;

first mounting means connected to said support for supporting said first motor in a fixed position within said first cylinder, including a first motor housing positioned in said first cylinder surrounding said first motor, a first fixed shaft fixed to said first housing and fixed to said support;

first transmission means for driving said first cylinder in rotation via said first motor drive shaft, said first transmission means including a first conical bevel gear positioned within said first cylinder coaxial with said first cylinder and a first conical bevel pinion connected to said first drive shaft and meshing with said first conical bevel gear;

a second motor positioned within said second cylinder, said second motor having a connected second drive shaft, said second motor being positioned within said second cylinder with said second drive shaft extending in a direction perpendicular to said second cylinder axis of rotation;

second mounting means connected to said support for supporting said second motor in a fixed position within said second cylinder, including a second motor housing positioned in said second cylinder surrounding said second motor, a second fixed shaft fixed to said second housing and fixed to said support;

second transmission means for driving said second cylinder in rotation via said second motor drive shaft, said second transmission means including a second conical bevel gear positioned within said second cylinder coaxial with said second cylinder and a second conical bevel pinion connected to said second drive shaft and meshing with said second conical bevel gear;

said cylinder bearing means including:

first cylinder bearing means with a bearing set mounted on said first fixed shaft and connected to said first cylinder; and second cylinder bearing means with a bearing set mounted on said second fixed shaft and connected to said second cylinder.

11. A fulling machine according to claim 10, wherein:

said first motor and first motor shaft have an axial dimension which is greater than said width of said first cylinder and said second motor and second motor shaft have an axial dimension which is greater than said width of said second cylinder.

12. A fulling machine according to claim 10, wherein:

each of said first and second transmission means further comprises a reduction gear set including a pinion keyed to a corresponding said first and second motor shaft and a gear wheel supported by an auxiliary shaft fixably attached to a corresponding first and second motor housing, said gear wheel being connected to a corresponding said first and second bevel pinion.

13. A fulling machine according to claim 10, wherein:

said motors are connected to a single inverter.

14. A fulling machine according to claim 10, wherein:

each of said first and second fixed shafts are hollow, a power supply connecting a corresponding said first and second motor to a power source through said hollow shaft.

15. A fulling machine according to claim 10, further comprising:

a plurality of fulling machines having said first cylinder and said second cylinder and having said first motor and said second motor, said fulling machines being positioned adjacent to each other and being independently operated.

* * * * *

UNITED STATES PATENT AND TRADEMARK OFFICE

CERTIFICATE OF CORRECTION

PATENT NO. : 5,274,891

DATED : January 4, 1994

INVENTOR(S) : Fiorenzo Biancalani

It is certified that error appears in the above-identified patent and that said Letters Patent is hereby corrected as shown below:

On the title page, Item [73] Assignee should read as follows:

--OFFICINA MECCANICA BIANCALANI &
C. DI BIANCALANI FIORENZO & C.S.n.c.
Firenze, Italy--.

Signed and Sealed this

Twenty-first Day of June, 1994

*Attest:*

Bruce Lehman

BRUCE LEHMAN

*Attesting Officer*

*Commissioner of Patents and Trademarks*